US007960924B2

(12) United States Patent
Fitz

(10) Patent No.: US 7,960,924 B2
(45) Date of Patent: Jun. 14, 2011

(54) DRIVE MECHANISM FOR A FURNITURE PART WHICH IS MOUNTED MOVABLY IN OR ON AN ITEM OF FURNITURE

(75) Inventor: Helmut Fitz, Lustenau (AT)

(73) Assignee: Julius Blum GmbH, Hochst (AT)

( * ) Notice: Subject to any disclaimer, the term of this patent is extended or adjusted under 35 U.S.C. 154(b) by 393 days.

(21) Appl. No.: 12/285,356

(22) Filed: Oct. 2, 2008

(65) Prior Publication Data

US 2009/0072687 A1 Mar. 19, 2009

Related U.S. Application Data

(63) Continuation of application No. PCT/AT2007/000110, filed on Mar. 6, 2007.

(30) Foreign Application Priority Data

Apr. 5, 2006 (AT) ..... A 584/2006

(51) Int. Cl.
*A47B 88/04* (2006.01)

(52) U.S. Cl. ..... 318/2; 318/558; 312/319.1; 312/319.5

(58) Field of Classification Search ..... 318/1, 2, 318/558; 312/319.1, 319.5, 319.8
See application file for complete search history.

(56) References Cited

U.S. PATENT DOCUMENTS 5,020,868 A * 6/1991 Brunnert ..... 312/319.1
5,207,781 A * 5/1993 Rock ..... 312/319.1
5,474,375 A * 12/1995 Hollenstein et al. ..... 312/319.1
2004/0107536 A1* 6/2004 Hollenstein ..... 16/94 R
2006/0238089 A1* 10/2006 Prentner et al. ..... 312/333

FOREIGN PATENT DOCUMENTS

| | | |
|---|---|---|
| DE | 20 2004 019 689 | 4/2005 |
| DE | 20 2005 002 433 | 6/2005 |
| EP | 1 127 514 | 8/2001 |
| EP | 1 314 842 | 5/2003 |
| EP | 1 598 509 | 11/2005 |

OTHER PUBLICATIONS

International Search Report issued Dec. 4, 2006 in the International (PCT) Application of which the present application is the U.S. National Stage.
International Search Report issued Oct. 23, 2008 in the International (PCT) Application of which the present application is the U.S. National Stage.

* cited by examiner

*Primary Examiner* — Bentsu Ro
(74) *Attorney, Agent, or Firm* — Wenderoth, Lind & Ponack L.L.P.

(57) ABSTRACT

A drive mechanism for a furniture portion, in particular a drawer or a door which is mounted movably in or to a furniture item, includes a drive device which is guided movably with respect to a base and which is acted upon by a force storage means, a damping device, and a retraction device. The drive device has an ejection element for moving the furniture portion from a closed end position into an open position, and a locking element which is guided by a preferably heart-shaped guide track which is formed on the base. The damping device, the force storage means which acts on the drive device, and the refraction device are connected in series.

22 Claims, 6 Drawing Sheets

DRIVE MECHANISM FOR A FURNITURE PART WHICH IS MOUNTED MOVABLY IN OR ON AN ITEM OF FURNITURE

This application is a continuation application of International application PCT/AT2007/000110, filed Mar. 6, 2007.

BACKGROUND OF THE INVENTION

The invention concerns a drive mechanism for a furniture portion, in particular a drawer or a door, which is mounted movably in or to a furniture item. The drive mechanism includes a drive device which is guided movably with respect to a base and which is acted upon by a force storage means, a damping device, and a retraction device. The drive device has an ejection element for moving the furniture portion from a closed end position into an open position and a locking element which is guided by a preferably heart-shaped guide track which is formed on the base.

In drive mechanisms of that kind which are known from the state of the art, it is usual for the drive device which is generally arranged on the furniture body or carcass to be coupled to the movable furniture portion, for loading the force storage means. In that case, the force storage means which is usually in the form of a spring is loaded over a part of the closing travel, wherein the energy required for that purpose is to be applied manually by the user. It has been found that that state of the art suffers from the problem that substantially more energy is introduced by the user as a consequence of exerting an excessive force on the movable furniture portion, than is required for loading the force storage means of the drive device. As a consequence of this, the locking element is moved into its locking position with a great deal of force and momentum, which, particularly when the arrangement has a heart-shaped guide track for the locking element, can have the result that locking of the drive device is released again of itself by virtue of the high speed of the movable furniture portion. In addition, as a further consequence, the movable furniture portion, when reaching the closed position, strikes against the furniture item or portions thereof.

For that purpose, it is further known for the movable furniture portion to be guided into the closed position by means of a damped retraction device, after loading and locking of the force storage means, on the part of the closing travel which is immediately prior to the closed position of the movable furniture portion. Admittedly, it is possible with such a damped retraction device to prevent the movable furniture portion from striking against the furniture item or portions thereof, but it is not possible to ensure that the locking element of the drive device is reliably arrested in a fashion which at the same time does not stress the material involved, when using such a damped retraction device which in fact comes into engagement only after locking of the force storage means.

SUMMARY OF THE INVENTION

Therefore, the object of the invention is to provide a drive mechanism of the kind set forth in the opening part of this specification, with which the disadvantages known from the state of the art can be avoided and which in addition represents a solution involving a low level of noise and without stressing the material involved.

That object is attained by the invention in that the damping device, the force storage means which acts on the drive device, and the retraction device are connected in series. In accordance with a preferred embodiment of the invention, it is provided that the damping device, the force storage means which acts on the drive device, and the retraction device are of such an arrangement and configuration that upon closure of the movable furniture portion the damping device acts on the drive device and after complete loading of the force storage means which acts on the drive device the movable furniture portion can be brought into the closed end position by means of the retraction device.

The arrangement according to the invention of the damping device, the force storage means, and the retraction device therefore ensures that, upon closure of the movable furniture portion, the movable furniture portion is braked by means of the damping device before the force storage means which acts on the drive device is loaded. Thus, at the beginning of the process of loading up the force storage means, the energy present substantially corresponds to the energy required for loading the force storage means so that the locking element of the drive device is moved into the latching position provided in the guide track, without unnecessary material wear and overdimensional generation of noise.

To achieve friction-less closing or opening movement of the movable furniture portion, a further embodiment of the invention provides that the active force of the force storage means which acts on the drive device is greater than the active force of the retraction device, and the active force of the retraction device is greater than the active force of the damping device.

In that respect, in accordance with a first embodiment of the invention, the damping device can be arranged at the drawer rail of a drawer extension guide system. In that case, it has been found to be structurally particularly simple if the damping device forms an entrainment member for the movable furniture portion and acts directly on the ejection element or an abutment element of the ejection element of the drive device. Alternatively, it would also be conceivable for the damping device to be arranged on the ejection element of the drive device in such a way that the damping device forms an abutment element for an entrainment member arranged on the drawer rail.

In accordance with an alternative embodiment of the invention, however, the damping device can also be arranged on the base, in relation to which the drive device is guided, and can act directly on the end of the drive device (that is, remote from the opening direction). That embodiment is particularly suitable in relation to narrow items of furniture in which there is a wish for a drawer guide system that is of a flat configuration.

The invention further concerns a method of opening and closing a furniture portion mounted movably in or to a furniture item, by means of a lockable drive device having at least one force storage means which is to be loaded manually by a user, a damping device and a retraction device.

In contrast to the previously known methods in which damping of the movable furniture portion is effected after complete loading of the force storage means, the method according to the invention provides that the movable furniture portion is braked upon closure in a first portion of the closing travel by means of the damping device. In a second portion of the closing travel, the force storage means which acts on the drive device is loaded and is locked before, in a further portion of the closing travel, with the force storage means loaded and locked, the movable furniture portion is moved into the closed end position against the active force of the damping device by means of the retraction device.

A further aspect of the invention concerns a drive mechanism for a furniture portion, in particular a drawer or a door, which is mounted movably in or to a furniture item. The mechanism includes a drive device which is guided movably with respect to a base and which is acted upon by a force storage means. The drive device has an ejection element for moving the furniture portion from a closed end position into an open position and a locking element which is guided by a preferably heart-shaped guide track which is formed on the base.

In that respect, in known drive devices of the general kind set forth, the ejection element and the locking element are generally rigidly connected together or are formed in one piece, which certainly has a positive effect on the stability of the drive device. On the other hand, with such a drive device, it is possible to influence the process of loading or unloading the force storage means, only by additional means which are mounted for example to the drawer extension guide system.

In order now to be able to influence the process of loading or unloading the force storage means, without having to arrange further components on the drawer guide system or on the furniture body or carcass, the ejection element and the locking element are adapted and arranged to be movable linearly relative to each other. A structurally simple and stable solution provides that the ejection element is guided at preferably elongated guide means of the locking element and/or the locking element is guided at preferably elongated guide means of the ejection element relative to the locking element and the ejection element respectively.

The configuration and arrangement according to the invention of the ejection element now permits a relative movement between the ejection element and the locking element. A preferred embodiment of the invention provides that the drive device has a force storage means acting between the ejection element and the locking element.

If the relative movement between the ejection element and the locking element should be used to slow down the momentum of the movable furniture portion as it closes before loading of the force storage means which acts on the drive device is started, a further embodiment of the invention provides that the force storage means is a damper, preferably a fluid damper.

It would also be conceivable to use the relative movement between the guide element and the ejection element, particularly in relation to large and heavy drawers, to assist the force storage means which acts on the ejection element, in ejecting the movable furniture portion. In that case, the force storage means disposed between the ejection element and the guide element would have to be in the form of a compression spring.

In accordance with a further embodiment, the drive device is arranged movably in a housing and the housing forms the base, in relation to which the drive device is movably guided. In that respect, it has proven to be structurally simple if the guide track for the locking element is provided in a boundary surface of the housing. In other words, the preferably heart-shaped guide track for the locking element is in the form of a through opening at a side face of the housing or disposed inwardly at a side face of the housing.

An inexpensive embodiment of the invention, which involves a low level of wear, further provides that the force storage means which acts on the drive device is formed by a spring, preferably a tension spring.

As a further embodiment of the invention, the drive device is mounted linearly movably in a housing. In that case, the force storage means which acts on the drive device is mounted with its one end at the housing, preferably at an end of the housing, and with its other end at the locking element. The ejection element is movable between the locking element and the mounting of the force storage means to the housing relative to the locking element that provides a particularly compact and space-saving structural unit for the drive device. For that purpose, it has further proven to be desirable if the force storage means which acts on the drive device is formed by two tension springs which extend in parallel relationship and which engage over the drive device and between which is arranged the force storage means which is in the form of a damper and which acts on the locking element and the ejection element.

A particularly simple possible way of fixing the drive mechanism to the furniture is afforded if the housing is of a substantially parallelepipedic configuration, wherein the bottom face is larger than the top face or vice-versa and is adapted for fixing the housing to the furniture item.

Although it would be basically possible for the ejection element to be allowed to strike at the end against the movable furniture portion, a preferred embodiment of the invention provides that the ejection element is of a substantially U-shaped configuration and has a laterally projecting abutment element for the movable furniture portion, and the housing in which the drive device is linearly movably guided has in a side face an exit opening extending in the longitudinal direction of the housing for the abutment element of the ejection element.

A structurally simple and stable solution which provides that the guide element is safely and securely guided in the guide track provides that the locking element has a pivotably mounted locking lever on which there is arranged a guide projection for engagement into the guide track provided on the housing. A particularly flat structure can be achieved for the drive device if the abutment element of the ejection element and the locking lever of the locking element lie substantially in a common plane.

In order to ensure that the movable furniture portion which is slowed down by means of the damping device is reliably moved into its closed end position after complete loading of the force storage means and locking thereof, a further embodiment of the invention provides that the drive mechanism, besides the force storage means for the drive device and the force storage means which is in the form of a damper and which is operative between the ejection element and the locking element further has a retraction device.

BRIEF DESCRIPTION OF THE DRAWINGS

Further advantages and details of the invention are described more fully in the specific description hereinafter with reference to the embodiments illustrated in the drawings, in which.

DETAILED DESCRIPTION OF THE INVENTION

Figure 1:
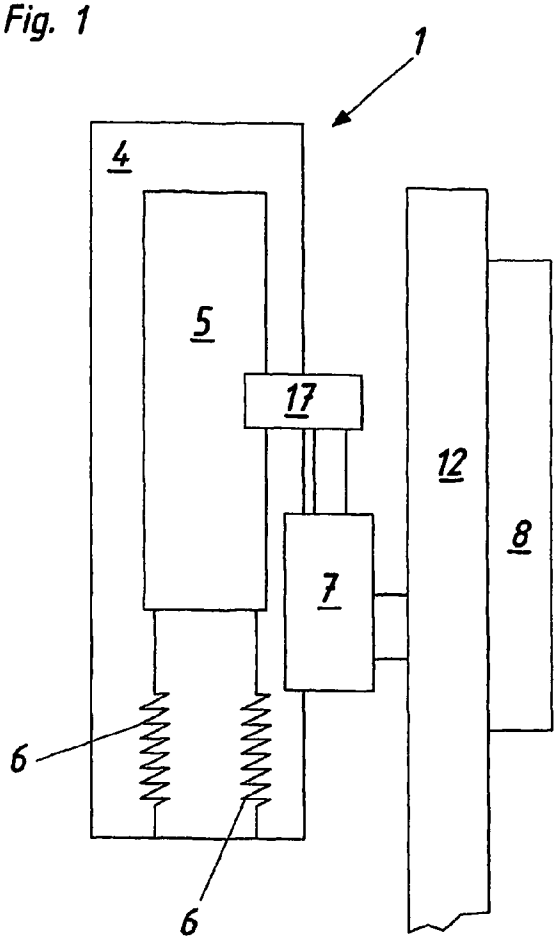
FIG. 1 shows a first embodiment of the invention.

In the first embodiment of a drive mechanism 1 according to the invention, diagrammatically shown in FIG. 1, both the base 4 in relation to which the drive device 5 is linearly movable and also the retraction device 8 are arranged on an item of furniture (not shown) stationarily, for example on a furniture body rail of a drawer extension guide system. The lockable drive device 5 functions in accordance with the per se known touch-latch system and is acted upon by a force storage means 6 which in the illustrated embodiment is formed by two tension springs.

The drive device 5 further has an abutment element 17 for coupling the drive device 5 to the movable furniture portion (also not shown).

The movable furniture portion is mounted movably in the furniture item by way of the drawer rail 12 of a drawer extension guide system, wherein coupling of the drawer rail 12 to the abutment element 17 of the drive device 5 is effected by way of an entrainment member which in this first embodiment is formed by the damping device 7.

Figure 2:
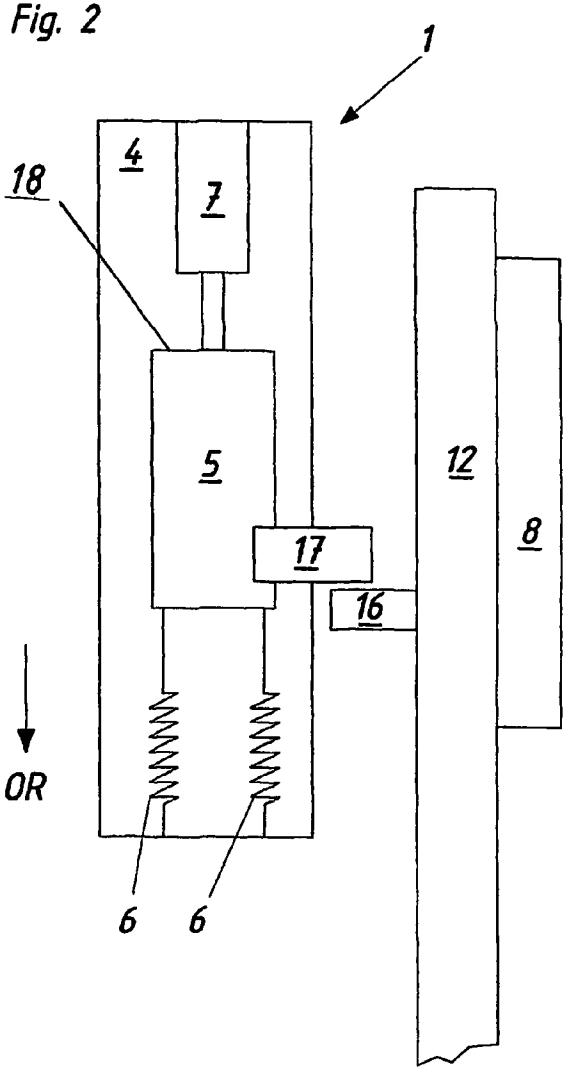
FIG. 2 shows a second embodiment of the invention.

FIG. 2 shows a further embodiment of a drive mechanism 1 according to the invention. This second embodiment differs from the embodiment of FIG. 1 in that the damping device 7 is now no longer associated with the movable drawer rail 12, but is arranged like the drive device 1 on the base 4, in relation to which the drive device 5 is movably mounted. In that case, the arrangement of the damping device 7 is such that the piston of the damping device 7 acts directly on the end 18 of the drive device 5, that is remote from the opening direction OR. In addition arranged on the drawer rail 12 is a separate entrainment member 16, by way of which the movable furniture portion is coupled to the abutment element 17 of the drive device 5.

Figure 3:
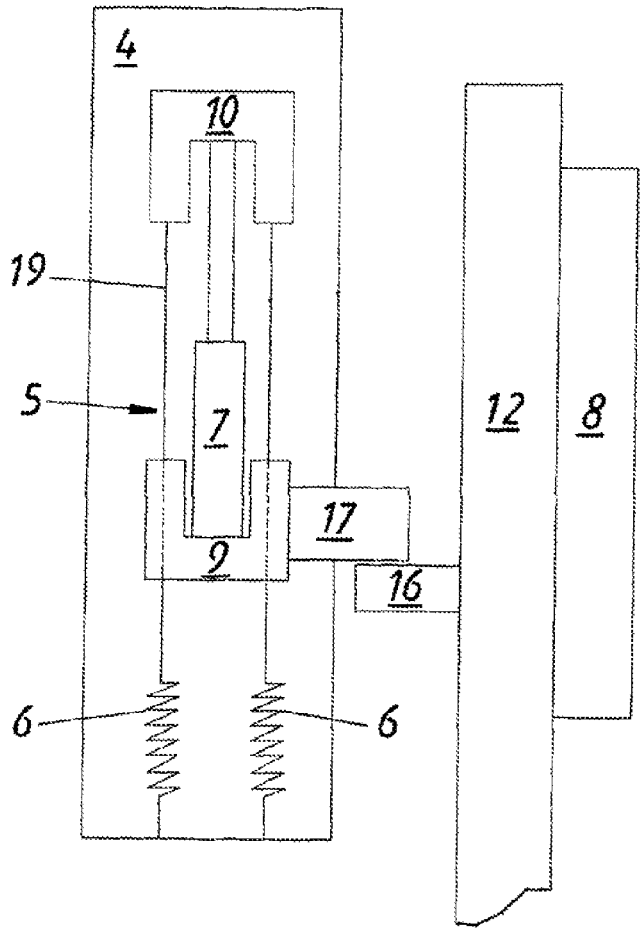
FIG. 3 shows a third embodiment of the invention.

A further embodiment is shown in FIG. 3. Similarly to the embodiment of FIG. 2 the damping device 7 is again associated with the stationary base 4. Unlike the embodiment of FIG. 2, however, in this third embodiment the drive device 5 has a two-part structure and has a locking element 10 and an ejection element 9 which are displaceable with respect to each other on guide means 19. In this arrangement the damping device 7 is operative between those two mutually relatively movable parts (i.e., between ejection element 9 and locking element 10) of the drive device 5. In this embodiment, the abutment element 17 is associated with the ejection element 9 and serves once again for coupling the drive device 5 to the movable furniture portion, more specifically by way of the entrainment member 16 arranged on the drawer rail 12.

Figure 4:
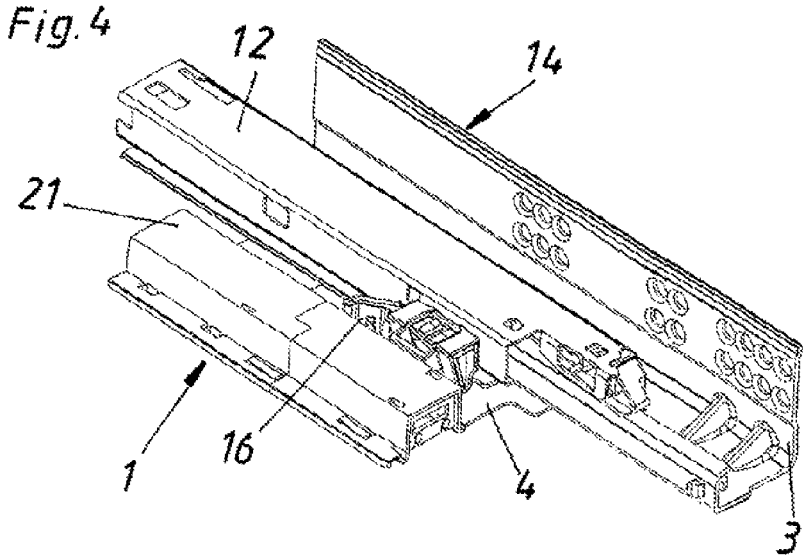
FIG. 4 shows the arrangement of a drive mechanism according to the invention on a drawer extension guide system.

FIG. 4 shows the arrangement of a drive mechanism 1 according to the invention on a drawer extension guide system 14. In this case the drive device 5 is arranged linearly movably in a housing 21, wherein the bottom face of the housing 21 at the same time forms the base 4, in relation to which the drive device 5 is linearly movable. That base 4 is connected to the furniture body or carcass rail 3 arranged stationarily on the furniture carcass, while the drawer rail 12 with the entrainment member 16 arranged thereon is displaceable linearly with respect to the body or carcass rail 3, for example with the interposition of a central rail.

Figure 5:
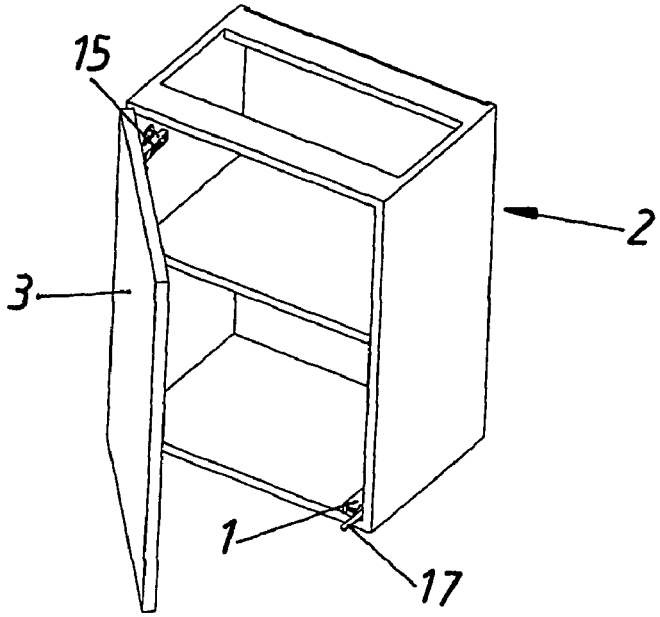
FIG. 5 shows a furniture item with a drive mechanism according to the invention.

FIG. 5 shows a furniture item 2 in which the movable furniture portion 3 is in the form of a door mounted rotatably to the furniture body or carcass by way of a hinge 15. The drive mechanism 1 is arranged stationarily on the furniture carcass, and the abutment element 17 of the ejection element 9 of the drive device 5 in this embodiment acts directly on the movable furniture portion 3.

Figure 6A:
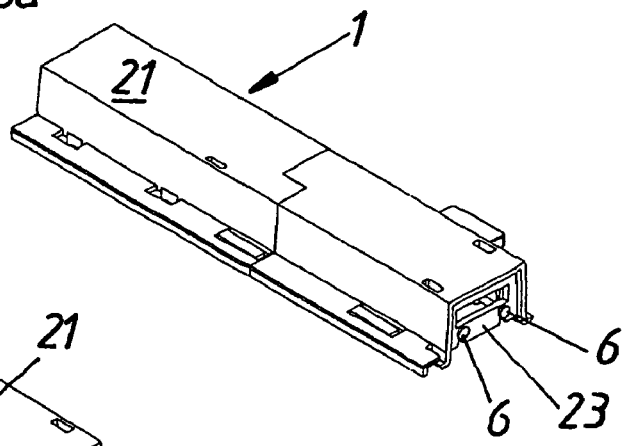
FIGS. 6*a* and 6*b* show a perspective view and an exploded view of the drive mechanism of FIG. 4, FIGS. 7*a* and 7*b* show a perspective view and an exploded view of the drive mechanism of FIG. 5, and FIGS. 8*a* to 8*d* show diagrammatic views illustrating the principle of different positions of the embodiment of FIG. 3 during a closing movement of the movable furniture portion.
Figure 6B:
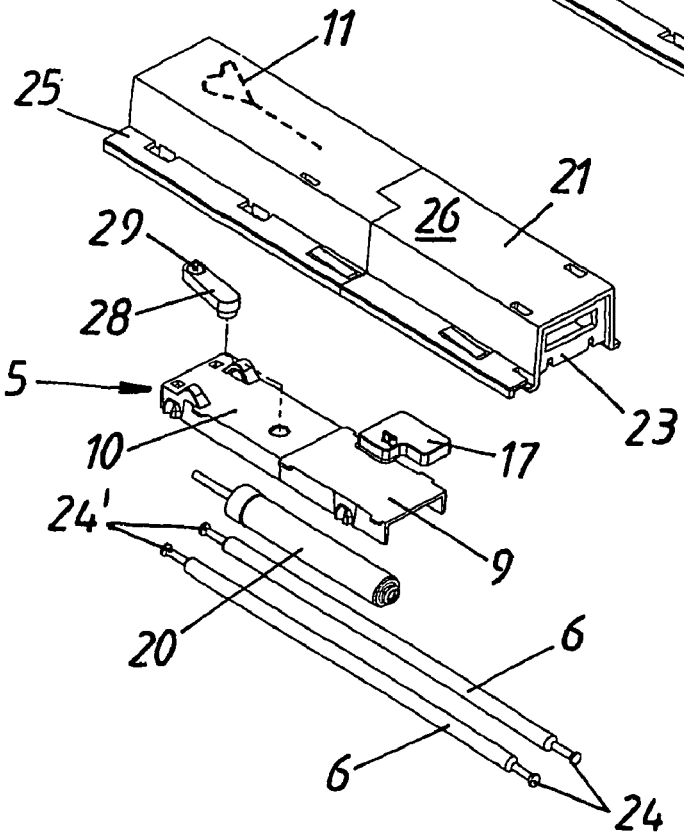

FIGS. 6*a* and 6*b* show a perspective view and an exploded view of the embodiment of FIG. 4. It will be seen here that the force storage means 6 which acts on the drive device 5 is formed by two tension springs. The drive device 5 is arranged in a housing 21 and has a locking element 10 as well as an ejection element 9. A force storage means 20 which in the illustrated embodiment is formed by a fluid damper is operative between those two mutually relatively movable parts (locking element 10 and ejection element 9). Arranged pivotably on the locking element 10 is a locking lever 28 which is guided by way of a guide projection 29 in a guide track 11 having a heart-shaped configuration on the inside of the top face 26 of the housing 21.

Provided on the ejection element 9 is a laterally projecting abutment element 17, by way of which the drive mechanism 1 is coupled to the movable furniture portion 3.

Figure 7A:
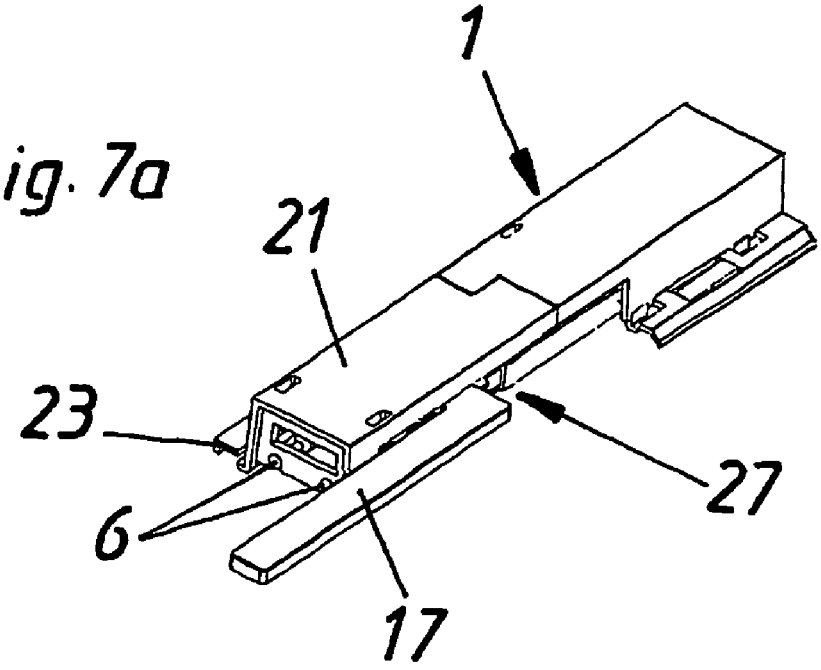
Figure 7B:
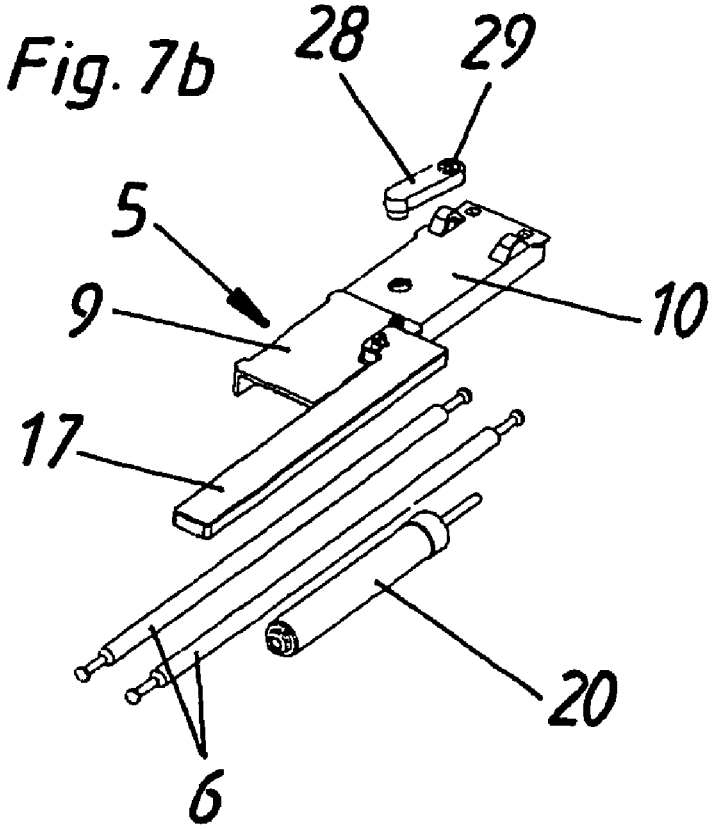

The drive mechanism 1 shown in FIG. 6*a* is illustrated in FIGS. 7*a* and 7*b* as a perspective view and an exploded view, similarly to FIGS. 6*a* and 6*b*. The embodiment of FIGS. 7*a* and 7*b* differs from that of FIGS. 6*a* and 6*b* in that the abutment element 17 is of a greater longitudinal extent in the opening or closing direction of the movable furniture portion. Thus, the abutment element 17 can act directly on the movable furniture portion 3, which is necessary when using the drive device 1 according to the invention in relation to a furniture item 2 with a door or flap.

The mode of operation of the drive device according to the invention is described hereinafter with reference to FIGS. 8*a* to 8*d* in relation to different positions of the embodiment of FIG. 3 during the closing movement of a movable furniture portion.

Figure 8A:
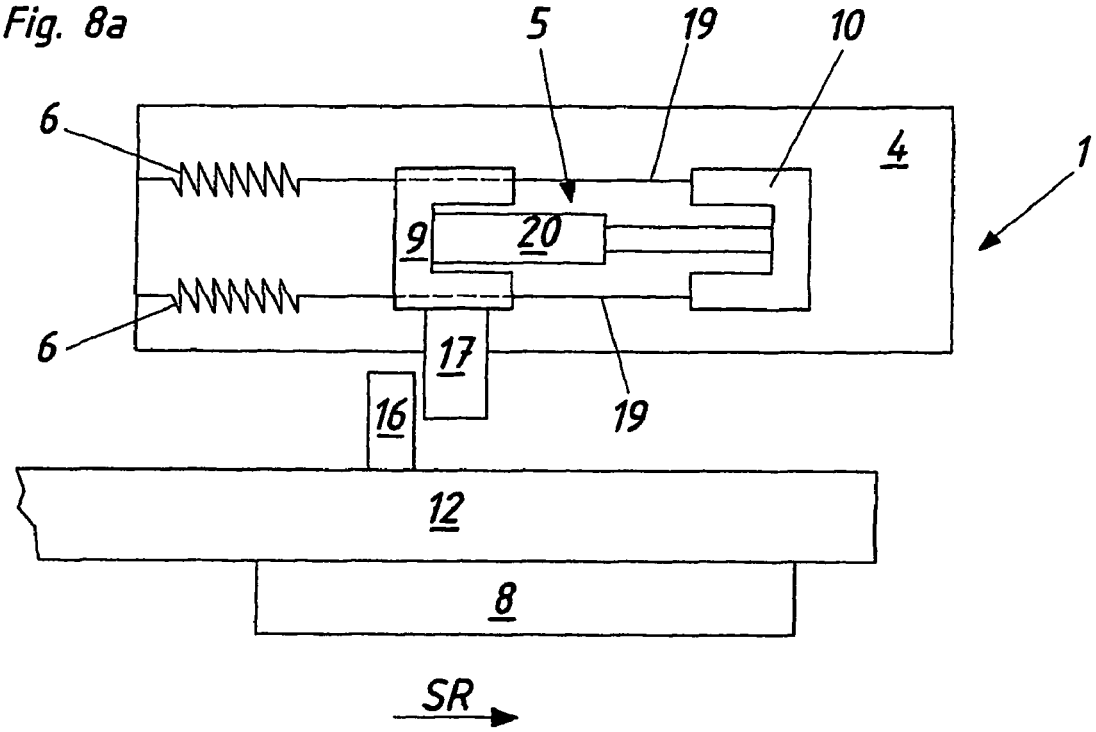

In this case, the movable furniture portion which is not shown for the sake of clarity is just closed in FIG. 8*a*, and the entrainment member 16 of the drawer rail 12 is shown directly prior to engagement with the abutment element 17 of the drive device 5. At that moment, the force storage means 6 of the drive device 5 is completely relieved of load, and likewise the force storage means 20 which is in the form of a damper and which is operative between the locking element 10 and the ejection element 9 of the drive device 5 is also relieved of load.

Figure 8B:
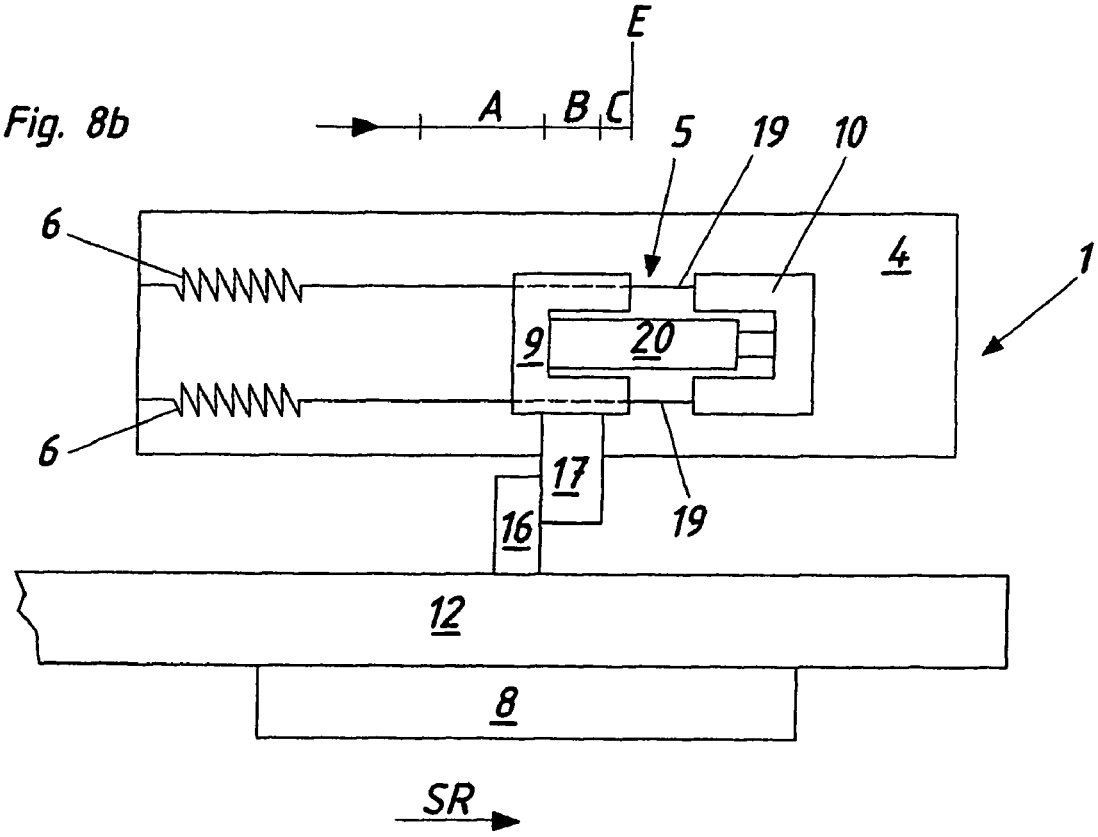

If now the movable furniture portion moves further in the closing direction SR, the entrainment member 16 on the drawer rail 12 engages the abutment element 17 of the drive device 5 and entrains the ejection element 9 in the closing direction SR (FIG. 8*b*). In that first part A of the closing travel of the movable furniture portion, the movable furniture portion is braked as a consequence of the force storage means 20 acting as a damper between the locking element 10 and the ejection element 9, and the active force of the force storage means 20 in the form of the damper depends on the speed at which the movable furniture portion is closed.

Figure 8C:
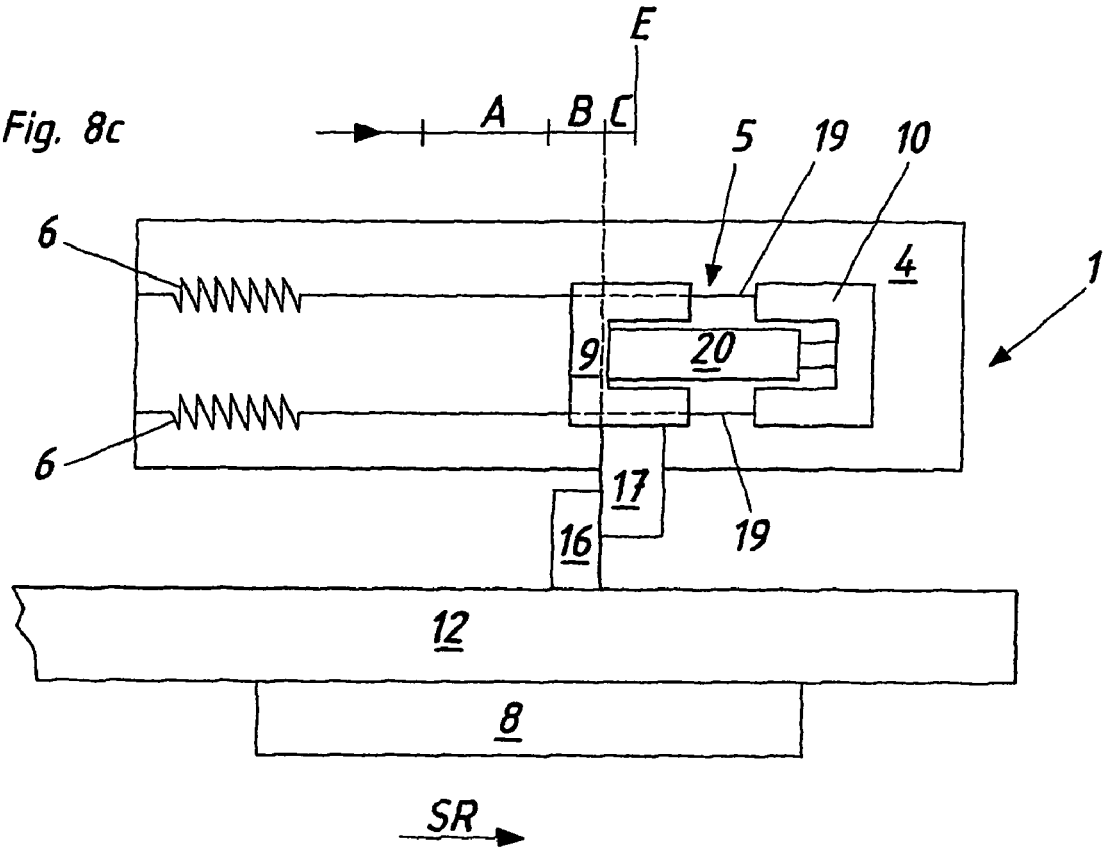
Figure 8D:
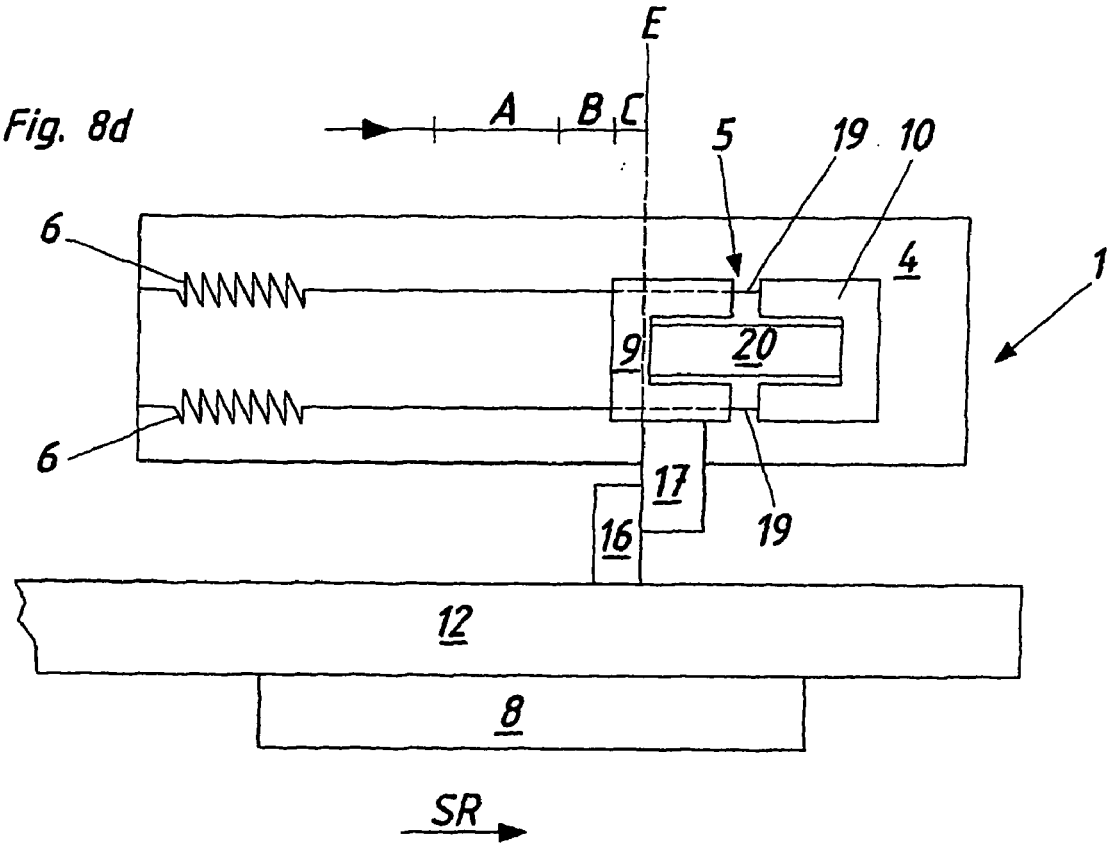

Then, as shown in FIG. 8*c*, the force storage means 6 which acts on the drive device 5 is loaded on the second part B of the closing travel of the movable furniture portion. During that loading process, substantially no relative movement takes place between the locking element 10 and the ejection element 9 of the drive device 5.

When the force storage means 6 is loaded and locked, the movable furniture portion is moved into its closed end position by means of the retraction device 8 over the last part C of its closing movement against the active force of the force storage means 20.

Triggering of the drive device 5 and thus ejection of the movable furniture portion are effected using the per se known touch-latch principle, for which reason the opening process is not described in detail here.

It will be appreciated that the invention is not limited to the illustrated embodiments. Thus it would certainly be conceivable for the retraction device to be associated with the base, in relation to which the drive device is movable, particularly when the movable furniture portion is formed by a door or flap and the hinge does not have a closure mechanism. In that case, it is necessary to arrange a retaining device, for example a magnet, between the abutment element of the ejection element and the movable furniture portion or the entrainment member of an extension guide system.

The illustrated embodiments of a drive mechanism for a furniture portion mounted movably in or at a furniture item as well as the described example of a possible method of opening and closing a movable furniture portion are obviously not to be interpreted in a restrictive sense but only as individual examples of numerous possible ways of implementing the concept of the invention of a drive mechanism for a furniture portion mounted movably in or at a furniture item.

The invention claimed is:

1. A drive mechanism for a furniture portion, which is mounted movably in or to a furniture item, said drive mechanism comprising:

a drive device which is guided movably with respect to a base and which is acted upon by a force storage means, a damping device, and a retraction device, wherein the drive device has an ejection element for moving the furniture portion from a closed end position into an open position, and has a locking element which is guided by a heart-shaped guide track which is formed on the base, and wherein the damping device, the force storage means which acts on the drive device, and the retraction device are connected in series.

2. A drive mechanism according to claim 1, wherein the damping device, the force storage means which acts on the drive device, and the retraction device are arranged and configured so that, upon closure of the movable furniture portion, the damping device acts on the drive device and after complete loading of the force storage means which acts on the drive device, the movable furniture portion can be brought into the closed end position by the retraction device.

3. A drive mechanism according to claim 1, wherein an active force of the force storage means which acts on the drive device is greater than an active force of the retraction device, and the active force of the retraction device is greater than an active force of the damping device.

4. A drive mechanism according to claim 1, wherein the damping device is arranged at a drawer rail of a drawer extension guide system.

5. A drive mechanism according to claim 4, wherein the damping device forms an entrainment member for the movable furniture portion and acts directly on the ejection element or on an abutment element of the ejection element of the drive device.

6. A drive mechanism according to claim 1, wherein the damping device is arranged on the base, in relation to which the drive device is movably guided, and the damping device acts directly on an end of the drive device, the end being remote from the opening direction.

7. A method of opening and closing a furniture portion mounted movably in or to a furniture item, by means of a lockable drive device having at least one force storage means which is to be loaded manually by a user, a damping device, and a retraction device, said method comprising:

braking the movable furniture portion upon closure in a first portion of the closing travel by means of the damping device, after said braking, loading and locking the force storage means in a second portion of the closing travel, the force storage means being configured to act on the drive device, and after said loading and locking and with the force storage means loaded and locked, the movable furniture portion is moved into the closed end position against an active force of the damping device by means of the retraction device in a further portion of the closing travel.

8. A drive mechanism for a furniture portion which is mounted movably in or to a furniture item, said drive mechanism comprising:

a drive device which is guided movably with respect to a base, and which is acted upon by a force storage means, wherein the drive device has an ejection element for moving the furniture portion from a closed end position into an open position, and has a locking element which is guided by a heart-shaped guide track which is formed on the base, and wherein the ejection element and the locking element are adapted and arranged to be linearly movable relative to each other.

9. A drive mechanism according to claim 8, wherein the ejection element is guided by an elongated guide means of the locking element, and/or the locking element is guided by an elongated guide means of the ejection element relative to the locking element and the ejection element, respectively.

10. A drive mechanism according to claim 8, wherein the drive device has a force storage means acting between the ejection element and the locking element.

11. A drive mechanism according to claim 10, wherein the force storage means is a fluid damper.

12. A drive mechanism according to claim 8, wherein the drive device is arranged movably in a housing, and the housing forms the base, the drive device is movably guided in relation to the base.

13. A drive mechanism according to claim 12, wherein the guide track for the locking element is provided in a boundary surface of the housing.

14. A drive mechanism according to claim 12, wherein the housing has a substantially parallelepipedic configuration, the bottom face being larger than the top face or vice-versa, and the bottom face being adapted for fixing the housing to the furniture item.

15. A drive mechanism according to claim 12, wherein the locking element has a pivotably mounted locking lever on which there is arranged a guide projection for engagement into the guide track provided on the housing.

16. A drive mechanism according to claim 8, wherein the force storage means which acts on the drive device is formed by a tension spring.

17. A drive mechanism according to claim 8, wherein the drive device is mounted linearly movably in a housing, and the force storage means which acts on the drive device is mounted with a first end of the force storage means at an end of the housing, and with a second end of the force storage means at the locking element, wherein the ejection element is movable between the locking element and the mounting location of the force storage means to the housing relative to the locking element.

18. A drive mechanism according to claim 17, wherein the force storage means which acts on the drive device comprises two tension springs which extend in parallel relationship and which engage over the drive device, and the force storage means which is in the form of a damper is located between the two tension springs, and the force storage means acts on the locking element and the ejection element.

19. A drive mechanism according to claim 8, wherein the ejection element has a substantially U-shaped configuration, and has a laterally projecting abutment element for the movable furniture portion.

20. A drive mechanism according to claim 19, wherein a housing in which the drive device is linearly movably guided has a side face having an exit opening extending in the longitudinal direction of the housing for receiving the abutment element of the ejection element.

21. A drive mechanism according to claim 19, wherein the abutment element of the ejection element and a locking lever of the locking element lie substantially in a common plane.

22. A drive mechanism according to claim 8, wherein the force storage means is in the form of a damper and is operative between the ejection element and the locking element, said drive mechanism further comprising a retraction device.

* * * * *